US005474400A

United States Patent [19]

Kliefoth et al.

[11] Patent Number: 5,474,400

[45] Date of Patent: Dec. 12, 1995

[54] RADON REMEDIATION IN FORM-DRAIN APPARATUS

[75] Inventors: Christopher J. Kliefoth, Orefield, Pa.; Alton F. Parker, Clifton Park, N.Y.

[73] Assignee: CertainTeed Corporation, Valley Forge, Pa.

[21] Appl. No.: 156,016

[22] Filed: Nov. 23, 1993

[51] Int. Cl.[6] ..... E02D 31/00; E02B 11/00

[52] U.S. Cl. ..... 405/229; 52/169.5; 405/45

[58] Field of Search ..... 405/36, 45, 50, 405/52, 229; 52/169.5, 294

[56] References Cited

U.S. PATENT DOCUMENTS

| | | | |
|---|---|---|---|
| 994,155 | 6/1911 | Harris . | |
| 3,017,722 | 1/1962 | Smith | 50/100 |
| 3,613,323 | 10/1971 | Hreha | 52/169 |
| 4,185,429 | 1/1980 | Mendola | 52/274 |
| 5,120,162 | 6/1992 | Pasrker | 405/229 |
| 5,127,768 | 7/1992 | Crawshaw et al. | 405/229 |
| 5,356,240 | 10/1994 | Schuler | 405/229 |

*Primary Examiner*—David H. Corbin

[57] ABSTRACT

A permanent form-drain network adapted for radon remediation. A permanently installed form-drain system is partially piecewise modified and adapted to collect and remove radon gas from sub-slab, as well as basement and similar near-subterranean, portions of building. The partial piecewise modification of an existing form-drain includes adapting existing connector elements of the form-drain with vent tubes and differently molded pieces such as offset transition conduits and "T" shaped divergent conduits. The method for installing the invention conceives of the use of a radon accretion zone gas barrier made of an impermeable membrane.

12 Claims, 2 Drawing Sheets

RADON REMEDIATION IN FORM-DRAIN APPARATUS

BACKGROUND OF THE INVENTION

1. Field of the Invention

This invention relates generally to a gas accretion and removal system and in particular, to a combination form-drain structure with collecting and venting-exhausting substructures that are used to remediate gaseous accretions located mainly below grade or in subterranean portions of building structures. The collection structure relates to permanent, in-situ footing/foundation forms and cojoined collecting networks which are both hollow and foraminous; while, vent and exhaust structures relate to nonforaminous manifolds, conduits and both power ventilation and natural (chimney) subsystems.

2. Background Information

Among other noxious gases, radon has been identified as a factor which increases the risk of cancer. The Environmental Protective Agency (EPA) has identified certain areas of the country which, due to geological conditions, have high levels of radon present. Additionally, it has determined the maximum allowable level for human safety to be four (4) picocuries per liter (pCi/L). Because of this requirement, in many areas of the country, radon testing is routine whenever a residence is sold. Irrespective of whether a structure is to be used as a residence, radon remediation could reasonably be required anytime a structure is identified as a radon or noxious gas accretion area.

Some states require testing and remediation if the radon level exceeds 11 picocuries per liter. Based on one of the instant inventor's discussions with EPA and other industry sources, he is confident in predicting that Housing and Urban Development/Federal Housing Administration (HUD/FHA) will soon adopt this radon testing requirement in a uniform enforcement code since mortgages sold in the secondary market must meet HUD/FHA standards.

Quite similar to the radon problem, other noxious gases may accumulate, in structures or in subterranean locations, which can pose general health or safety problems. The instant inventors, therefore, have devised a method and apparatus, for remediating concentrations of unwanted gases or fumes, and which are to be used at the inception of construction or development. By adapting a dual function form-drain structure with a third function, that of providing sub-slab (or subterranean) ventilation, they have developed and provided an elegant and cost-effective remediation system that is installed concurrently with the erection of most structures. Thus, the instant invention may be viewed as either an improvement to an existing form-drain system or, alternatively, a "defugation" system, the latter being a system for removing overheated air or noxious gases.

3. Discussion of Relevant Art

A building foundation form having an integral drain is disclosed in U.S. Pat. No. 5,120,162, issued on Jun. 9, 1992. One of the instant inventors developed this apparatus which cofeatures a concrete footing/foundation retainment and an integral (unitary) drainage means. A rigid, environmentally non-degradable and free-standing footing/foundation concrete retainment form emulates an ordinary plank, but features a hollow core through each component thereof that communicates through a singular foraminous surface with the soil in which the form-drain is situate. Notwithstanding the importance of the mainline foraminous components, the transition and connecting pieces of the form-drain network are of particular importance in that these necessary components of the form drain system disclosed in '162 are an important cofeature of the instant invention. For this reason, U.S. Pat. No. 5,120,162 is hereby incorporated in this application, by reference.

As will be noted hereinafter, only one component of '162, a corner connector, is disclosed having diverse structure (i.e., not necessarily of the type and style of conduit exemplary of the invention proper). Another patent, U.S. Pat. No. 994,155, bears some resemblance to the above. However, '155 is noteworthy because it discloses an irrigation apparatus, that is, a subterranean or at least surface-situated, network of foraminous ducts or pipes that are connected to a vertically ascending pipe, which is connected thereafter to a water holding tank. Intuitively, this differs from '162 in that its function is diametrically the opposite and there is no disclosure or teaching for the use of this double sided, perforated irrigation duct as a concrete form. Most distinctive, however, is the operative feature of '155 wherein water or liquid fluid is introduced to the vertical conduit and allowed to gravity-flow into the foraminous ducting network and out the foramens thereof. Similar to '162 is U.S. Pat. No. 3,017,722, which discloses a hollow, single-sided foraminous stringer. It is used only in the outer peripheral portion of a concrete form and, in itself bears only a single bottom port for drainage to a header box and ultimately, to a sump. It is clearly the intention of the patentee of '722 to provide an exterior peripheral stringer which serves to partially drain a footing; its interior peripheral counterpart is removed and is simply not intended to function as the analogous interior peripheral structure of '162 and the instant invention.

A form and drain tile composite is disclosed in U.S. Pat. No. 3,613,323, issued on Oct. 19, 1971. Although disclosing a primary conduit having foramens at one side, this teaching is noteworthy only in that it lacks the very connective and transition pieces that are essential to the instant invention. Further, '323 deliberately teaches the covering of top-side ports, should the ports not be fitted with stakes for transfixing the main conduits to the ground. U.S. Pat. No. 3,613,323 is also silent as to whether the form-drain is adaptive to a gas scavaging and removal system. Finally, U.S. Pat. No. 4,185,429, issued on Jan. 29, 1980, discloses an apparatus for waterproofing a basement or similar structure. Although not intended as a footing per se, this patent discloses a drainage system which could be adapted for the use taught by the instant inventors, but for certain contradistinctions: the structure is meant to be positioned at an interior wall of a structure, above the footing; it has multiple holes on the upper surface thereof, but suggests no means for manifolding the holes in order to collect gaseous accretions; nor is there any suggestion made by the patentee that the drainage network be placed predominantly below the slab, adjacent to and interior of the footing as a single crossrun or a grid/network.

4. State of the Art

Currently, remediation of noxious gases consists in providing air flow around the basement slab (or crawl space) of a building so that heavier-than-air gases (e.g. methane, carbon monoxide dioxide, hydrocarbon fuels and/or radon) are dispersed outside the living space. Hereinafter, the inventors shall refer only to radon; however, it should be understood by the reader that any of the foregoing gases may also be considered as hazards of the type to be removed by the instant invention. The one notable distinction between radon and any of the other gases is that the hazardous component of the former is filterable, while the others may be scavenged only by the use of activated charcoal, captivating media, or the like. It is in the radioactive decay of radon, with the adherence of internally hazardous, radioactive daughter products to minute dust particles, including living tissue, that radon outgassing becomes a health concern. Thus, one sees the elegance of a system which removes the parent radon from a structure before it ever enters the living area and spawns its deadly daughter products. Contrary to good economization is the current practice of ventilating a living space, once the radon accumulates, because there is an energy loss factor in removing conditioned air.

Thus, the state-of-the-art does provide workable radon remediation systems, but at an enormous cost, comparatively speaking, in view of the concepts and apparatus offered by the instant inventors.

SUMMARY OF THE INVENTION

To provide radon remediation in a most expedient and cost-effective fashion, the form-drain system of U.S. Pat. No. 5,120,162 is adapted after a fashion which exploits the form-drain structure of the normal foundation form's interior loop. The interior loop of the form-drain system consists in a permanently installed, hollow conduit which is foraminous on a face inward of the footing. This interior loop, since it comprises a portion of the footing/foundation form, is, by definition, a subterranean installation. The subsoil below the slab is generally leveled off flush with the poured footing and is conterminous with the foraminous interface of the inner or interior form-drain. A vapor barrier is generally overlain the subsoil in order to contain radon which might outgas from the soil and seep through fractures or cracks in the concrete slab to the interior of the basement or subfloors of the building. The vapor barrier will contain such radon and urge it towards the form-drain conduit. Thereafter, when the slab is installed over the entire basement or first floor surface, the only incipient path for venting radon is into the interior form-drain loop by use of the loop only or in conjunction with a subslab scavenging network.

Once the radon accretion area and the form of the inner form-drain loop is installed, removal of radon is by a conduit or duct system which communicates directly with the interior of the form-drain, or components thereof, and with the ambient atmosphere. Generally, the instant inventors employ one of the following methods for communicatively ducting the form-drain inner loop and exhausting radon accretions to the atmosphere:

A. A vertical pipe run is made through the interior of the building and out the roof. Because of natural air flow over the vertical pipe, a negative air pressure is realized therein (chimney effect); radon is evacuated from inside the form-drain and, thus, from beneath the slab.

B. The method as in "A" above, with the addition of a power vent (fan) to provide more air flow volume and velocity.

C. A side outlet through the structure, below roof level or, at a position where chimney effect is not realizable. This requires power ventilation as in "B".

D. Connection of the inner loop of the form-drain to a "radon sump pit". This can merely be a sump which has the facility of enclosing a volume of gas to allow transition from the form-drain, through the sump and to an exhaust system such as "B" or "C" above.

Additional to the above methodology and apparatus for its realization, and should subslab ventilation be insufficient, cross runs between the inner loop are contemplated by the instant inventors. It is often advisable to emplace, under the slab, at least one cross run, or several to create a grid or network of cross run elements comprising foraminous ducts or tubes. Cross run elements or networks resemble septic field tile nets and are also accomplished by the use of a foraminous conduit as taught in U.S. Pat. Nos. 5,120,162, 4,185,429, 994,155, et al. The foraminous elements are fitted into special "T" connectors, both duct-type and tubular, that are inserted in lateral portions of the inner loop. The use of cross runs increases the scavaging feature of the instant invention and, since it is installed initially with the form-drain, contributes significantly to the system's cost effectiveness. In cases where surface water is a problem, cross runs enhance the water collection and remediation capability of the form-drain system.

DETAILED DESCRIPTION OF THE PREFERRED EMBODIMENT

Figure 1:
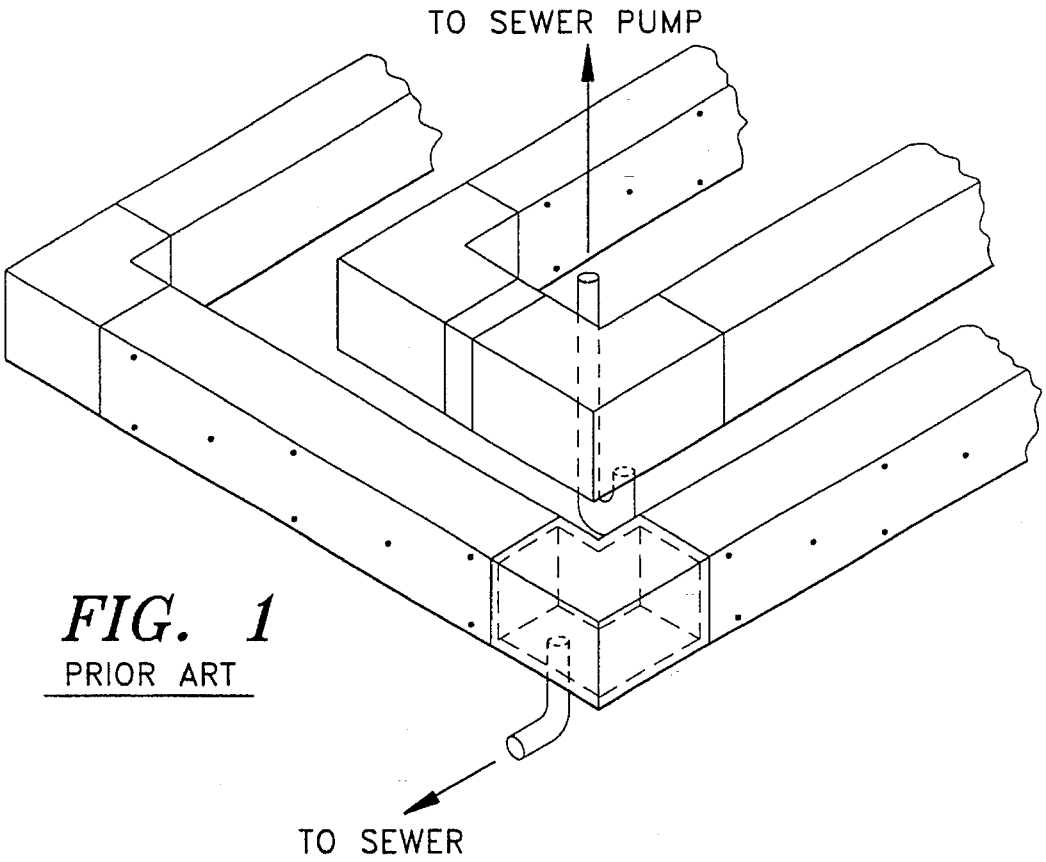
FIG. 1 PRIOR ART
FIG. 1 is an isometric illustration of a partial form-drain emplacement of the prior art.

Referring now to the drawings, FIG. 1 depicts a typical form-drain installation that was invented by one of the instant inventors. During this detailed description, references to form-drain systems will be made with the understanding that the FIG. 1 depiction is merely illustrative of the form-drain genre, but the instant invention has a general applicability to form-drains of types discussed earlier herein as Relevant Art. As is apparent from the FIG. 1 illustration, a form-drain of the instant conception is a plurality of hollow plank members bearing a plurality of holes, perforations or foramens at the side of the planks that will be facing soil or gravel fill. By definition, because the form-drain is used to construct the footings of buildings, it is properly referred to as a subterranean structure or emplacement. In the previously discussed form-drain patents, all drainage is from beneath the networks by a (form of) evacuation conduit. Most evacuation conduits are directed to sump pumps or sewage systems and gravity is generally the desired method of motivation. The only transition pieces disclosed are corner or other angular connectors and straight transition connectors (or couplers). The top surfaces of most form-drains, unless featuring foramens similar to those along at least one side thereof, are continuously solid surfaces. As FIG. 1 depicts, holes at the bottom surfaces exist only in corner (or angular) connectors or straight transition pieces and are generally directed to sewers or sump pumps. Because of its subterranean situs, the form-drain used in the instant invention is not only well situated for the collection of liquid accretions, but for gaseous as well. The remaining drawings will show how the instant inventors took advantage of the aforementioned form-drain system and exploited it and current construction techniques to solve the problem of removing radon from beneath slabs and in the lower confines of practically all types of buildings.

Figure 2:
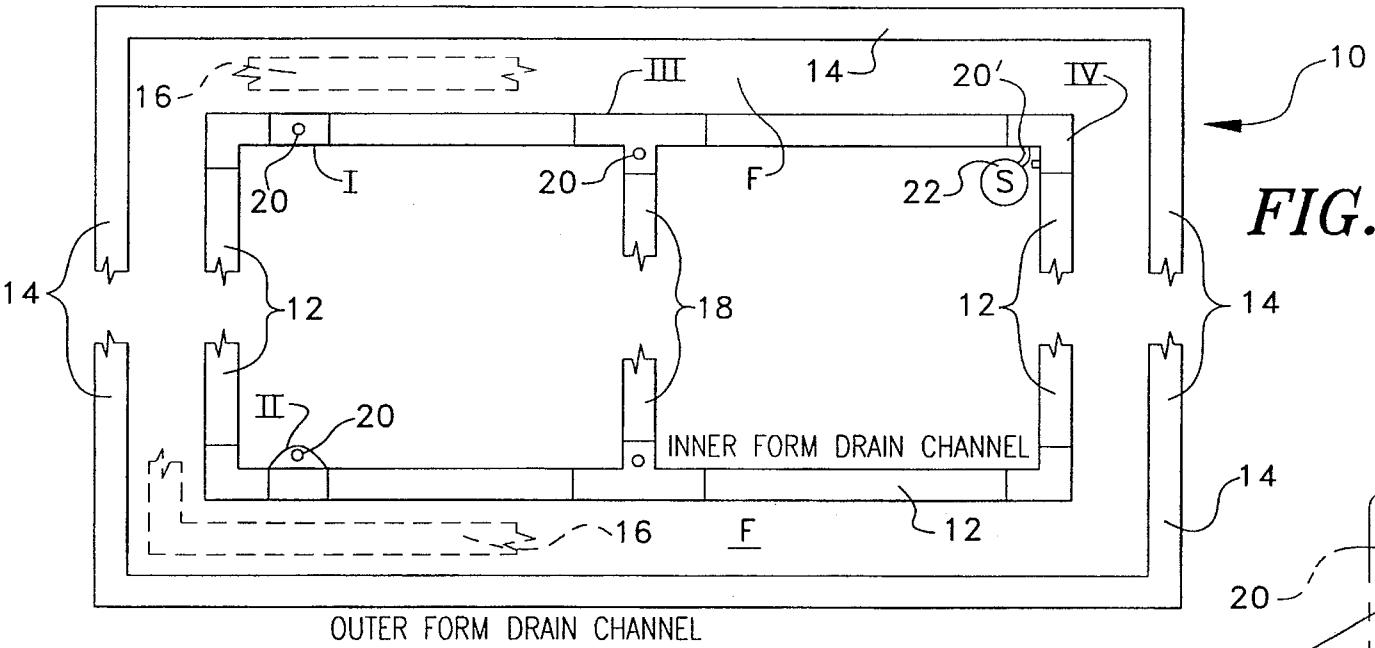
FIG. 2 is a partial plan view of a form-drain installation utilizing the instant invention.
Figure 4:
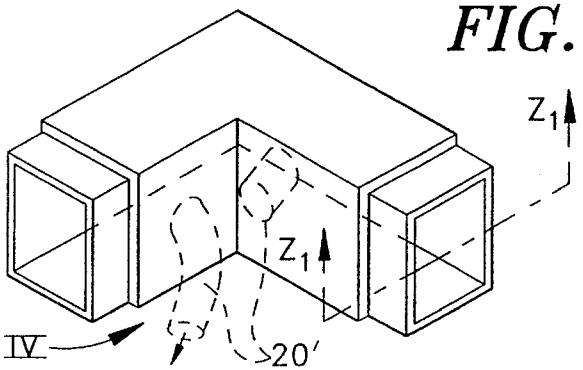
FIG. 4 is an isometric illustration of a corner connector for the form-drain bearing mode IV accouterment.

Referring more particularly now to FIG. 2, a partial plan of a form-drain installation 10 depicts an inner form-drain channel or loop 12, its correlative outer loop 14 and a typical cross run 18. The latter item will receive more comprehensive treatment in the discussion of FIG. 5. Although the actual building techniques may vary, dashed lines are used to represent, in part, the placement of a wall 16 on the footing F. Finally in FIG. 2, the instant invention is expressed elementally as four modalities of installation: mode I is a straight transition piece in the inner form-drain channel; mode II is likewise a straight transition piece in the inner form-drain channel and differs from mode I only in its transition to vertical pipe/tube 20; mode III is the "T" connector which will be discussed further at FIG. 5; and mode IV is a corner connector which may bear a lower drainage port as shown in FIG. 1 or other (preferred) accouterments as shown in FIG. 4, hereinafter. Modes I through III are equipped with a connection facility such as knock-out ports (not shown) or pipe attachment collars (not shown) that allow fixture of vertical pipes 20 with clean-out/flush ports (not shown) at any reasonable portion of the top surfaces thereof; such facilities are known in the art. Thus, the central location for pipe 20 in mode I, the offset or side location for pipe 20 in mode II and the "T" base location in mode III are merely illustrative and should be shaped and/or located at portions that the manufacturer of these elements considers most facilitative of gas removal. Mode IV may, as noted in FIG. 1, bear bottom ports for sump 22 drainage, but the instant inventors prefer a side vent 20' that is more clearly defined in FIG. 4 and which is, by virtue of lateral access, easier to install.

Figure 3:
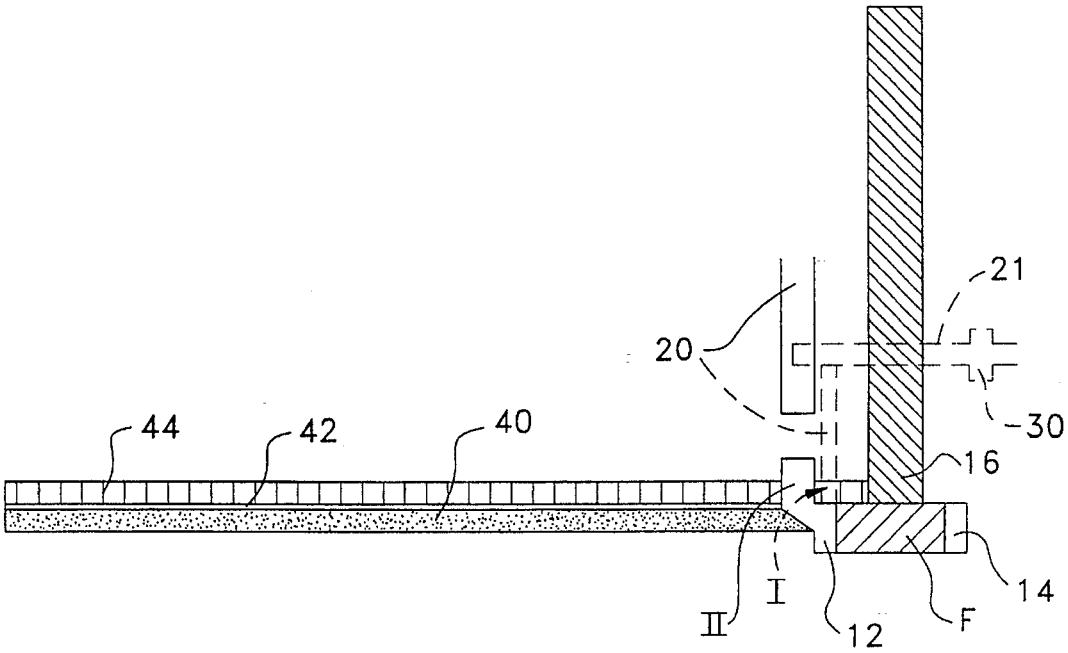
FIG. 3 is a partial elevational schematic of a form-drain emplacement with modes I and II of FIG. 2.

FIG. 3 best illustrates the instant invention's collecting and transport, as well as venting and exhausting, techniques to be used in the removal of radon accretions to the ambient atmosphere; a typical installation utilizing modes I and II of the instant invention is illustrated. This is the setup that would be viewed if a cross section were taken in FIG. 2 at the center of the mode I or II features. Here, the mode I transition piece depicts vertical pipe 20 rising directly above the channel 12, proper. Mode II is shown with the vertical pipe connector offset to the left hand side, being joined to a vertical pipe 20 as depicted by the opposing arrows. Either of the installations of vertical pipes 20 may be employed in the two modalities shown. Also depicted, through-wall venting 21 may conduct gases from either of the vertical piping arrays depicted to an external chimney (not shown) and, if such is not capable of a natural draft, assisted by power fan 30. Along the center and left side of FIG. 3, a typical radon accretion technique is illustrated. Subsoil 40, the predominant source of the radon outgasing, is leveled flush against the inner form-drain channel 12 and the footing F. Thereafter, an impermeable barrier 42 (generally a membranous vapor barrier) is overlain the subsoil, the upper surfaces of the form-drain 12 and footing F. Subsequently, a slab or suitable floor 44 is placed over the membrane 42. Thus, as the radon outgases from the ground 40, it is collected in portions (see FIG. 4) of the form-drain 12 that are not filled generally with water, to be collected or drawn off at the various vertical pipes 20, 21 or by way of other manifolding that the building contractor may devise.

FIG. 4 is an isometric drawing of a corner connector that is exemplary of both corner and other angular connectors (Ref. U.S. Pat. No. 5,120,162). Herein, the reader sees where pipes or manifold devices 20 are installed in or about Zone $Z_1$ of the connector, generally the gas accretion zone. Zone $Z_2$ is generally the liquid domain, but the demarcation between gas and liquid domains is rather arbitrary and not of any unusual significance. Irrespective of the containment of radon and its daughter products, in either the gaseous or liquid fluid media, the hazard will be removed by the instant invention in its adaptation to the illustrated form-drain system.

Figure 5:
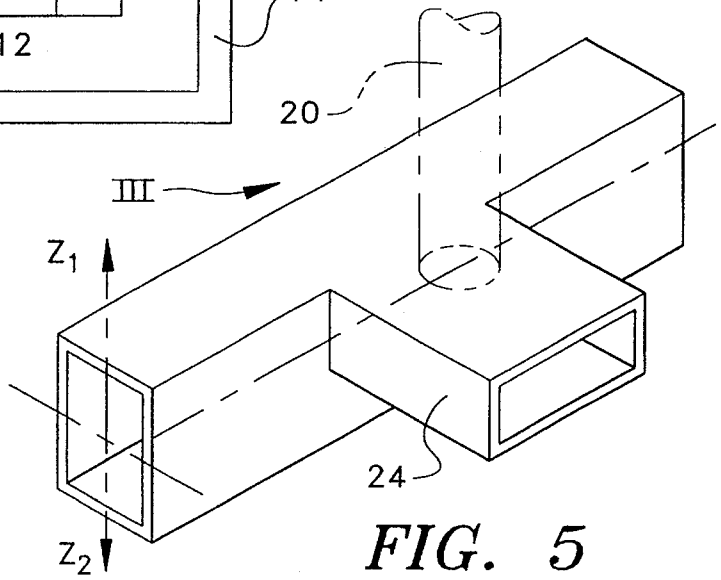
FIG. 5 is a isometric illustration of a mode III "T" connector for a form-drain that is used for installing cross runs for an inner form-drain channel.

Lastly, FIG. 5 discloses a special "T" connector, termed mode III, which modifies the original straight transition duct of the form-drain by addition of an orthogonal projection 24 that communicates with the interior of the transition element at approximately $Z_1$ portions thereof. As discussed earlier, vertical pipe 20 exhaust may be placed in either the base of the "T" or in either of the cross arms. The depicted embodiment conceives of fitting cross run duct 18 (see FIG. 2) in the manner previously discussed to aid in the collection of sub-slab gases. Cross run 18 may be a foraminous duct such as that used in the irrigation system of U.S. Pat. No. 994,155 (now incorporated by reference) or may be simply a typical plank-conduit of U.S. Pat. No. 5,120,162, but it should contain a far greater number of foramens to aid in the collection process. As would be apparent after seeing the instant "T" connector, one may readily modify the device so as to employ existing tubular, rather than rectangular, morphology (not illustrated) for the manufacture of divergent ports 24 or outlets. Further, such embodiments could (and probably would) be placed orthogonal to the connector proper and cover both zones $Z_1$ and $Z_2$. As stated earlier herein, such decisions are left to the manufacturer of the invention—to choose the most cost effective means of achieving an efficacious system.

Those of ordinary skill will find the instant invention a ready solution to the problem of radon and other noxious gas concentration. Practice of the invention will give rise to many different ventilation and exhaust techniques which should prove as useful as those disclosed herein. Use of the instant invention, in both methodology and apparatus, is commended to those in the field consistent with the hereinafter appended claims.

What is claimed is:

1. In combination with a foraminous footing form-drain structure, an improvement for collecting and removing gaseous accretions about a footing and beneath a slab proximate said structure comprising:

at least one structural piece of said form-drain disposed at a footing depth;

a conduit means fixed to an upper portion of said piece and communicating with the interior thereof; and an evacuation means for providing an exhaust draft at, and in communication with, said conduit means.

2. The improvement of claim 1 further comprising at least one foraminous, elongate element diverging from a portion of said form-drain and running therefrom and under a gas barrier.

3. The improvement of claim 1 further comprising at least two foraminous elements characterizing a fluid collection network that is connected to said structure and is disposed essentially beneath a ground floor of a building.

4. The improvement of claim 1 further comprising a gas barrier which substantially covers said structure at essentially soil level.

5. A gas removal means for venting the interior of a sub-slab gas barrier-covered, hollow footing form-drain apparatus comprising:

at least one form-drain transitional connector element having at least one duct diverging from thereout, the duct used for collecting gaseous substance from under said gas barrier; and exhaust means connected to an upper portion of, and in communication with, the interior of said element and said duct, said exhaust means comprising a pipe for the drawing therethrough of said gaseous substance.

6. The gas removal means of claim 5 wherein said transitional connector element comprises a means for connecting said duct thereto.

7. A footing form-drain improvement for removing gas therefrom and from soil thereabout comprising in combination:

a gas barrier immediately covering a substantial soil area, peripheral to, and further covering a portion of said form-drain;

a piece of said form-drain having a port in an upper portion thereof communicating with the interior of the said piece;

gaseous fluid ducting means joined to said port; and drawing means for motivating a gaseous fluid from out said ducting means.

8. The improvement of claim 7 further comprising a fluid scavenging network situated beneath the gas barrier and connected to the form-drain, said network comprising at least one foraminous, elongate element.

9. A method for venting to atmosphere gaseous accretions within essentially subterranean portions of a building comprising:

providing a subterranean, essentially sub-slab, foraminous hollow conduit network comprising a plurality of connected, hollow components, including discrete connectors, said network disposed in and surrounding a sub-slab gas accretion zone;

connecting to an upper portion of at least one discrete connector of said network at least one nonforaminous conduit communicating with the interior of said discrete component; and drawing from out said nonforaminous conduit, by an exhaust-venting means, any gaseous substances therein and exhausting said substances to ambient atmosphere, thereby venting said network and said subterranean portions.

10. The method of claim 9 wherein providing further comprises confining radon outgasing to said accretion zone by placing a gas impermeable barrier thereover and conterminous with peripheral top surfaces of said network.

11. The method of claim 9 further comprising joining of at least one cross-run foraminous element to a discrete component of said network that has a connection means therein for facilitating said joining.

12. The method of claim 9 further comprising cleaning through said at least one nonforaminous conduit which further comprises clean-out flushing means that communicates with the hollow network through said at least one discrete connector.

* * * * *